US008684516B2

(12) United States Patent
Baxter

(10) Patent No.: US 8,684,516 B2
(45) Date of Patent: Apr. 1, 2014

(54) TABLE FOR A PRINTER

(75) Inventor: William Ronald Stuart Baxter, Cambridge (GB)

(73) Assignee: Inca Digital Printers Limited (GB)

( * ) Notice: Subject to any disclaimer, the term of this patent is extended or adjusted under 35 U.S.C. 154(b) by 186 days.

(21) Appl. No.: 13/131,196

(22) PCT Filed: Nov. 25, 2009

(86) PCT No.: PCT/GB2009/051598
§ 371 (c)(1),
(2), (4) Date: Aug. 10, 2011

(87) PCT Pub. No.: WO2010/061221
PCT Pub. Date: Jun. 3, 2010

(65) Prior Publication Data

US 2011/0317144 A1 Dec. 29, 2011

(30) Foreign Application Priority Data

Nov. 26, 2008 (GB) ..... 0821627.7

(51) Int. Cl.
*B41J 2/01* (2006.01)

(52) U.S. Cl.
USPC ..... 347/104; 347/101; 271/194

(58) Field of Classification Search
CPC ..... G03B 27/58; B41J 2/01
USPC ..... 347/101, 104; 271/194
See application file for complete search history.

(56) References Cited

U.S. PATENT DOCUMENTS

| | | | | |
|---|---|---|---|---|
| 3,857,337 | A * | 12/1974 | Tsuji et al. | 101/123 |
| 5,133,543 | A * | 7/1992 | Eitel et al. | 271/276 |
| 6,209,867 | B1 * | 4/2001 | Madsen et al. | 271/276 |
| 6,254,092 | B1 * | 7/2001 | Yraceburu et al. | 271/276 |
| 6,336,722 | B1 * | 1/2002 | Wotton et al. | 347/102 |
| 6,637,960 | B2 * | 10/2003 | Garcia et al. | 400/648 |
| 6,733,109 | B1 | 5/2004 | Lorenz et al. | |
| 6,927,841 | B2 * | 8/2005 | Hinojosa et al. | 355/73 |
| 7,384,036 | B2 * | 6/2008 | Kruijt | 271/194 |
| 7,578,629 | B2 * | 8/2009 | Kruijt | 400/645 |
| 7,878,614 | B2 * | 2/2011 | Mitsuzawa | 347/16 |

(Continued)

FOREIGN PATENT DOCUMENTS

| | | |
|---|---|---|
| EP | 1308303 A1 | 5/2003 |
| EP | 1642728 A2 | 4/2006 |

(Continued)

*Primary Examiner* — Manish S Shah
*Assistant Examiner* — Jeremy Delozier
(74) *Attorney, Agent, or Firm* — Lerner, David, Littenberg, Krumholz & Mentlik, LLP

(57) ABSTRACT

A substrate support apparatus for a printer is described. The apparatus includes a table having a support surface for supporting a substrate during printing, the support surface including a plurality of substrate apertures. A negative pressure can be applied to the substrate apertures to hold the substrate to the table during printing.

The apparatus further includes a plurality of mask apertures, and a negative pressure can be applied to the mask apertures to hold a mask to the support surface.

By arranging for the pressure to be applied to the substrate apertures and mask apertures independently, the mask can be held to the table during loading and unloading of the substrate.

12 Claims, 3 Drawing Sheets

(56) References Cited

U.S. PATENT DOCUMENTS

| | | | | |
|---|---|---|---|---|
| 2002/0110400 | A1 | 8/2002 | Beehler | |
| 2003/0234851 | A1* | 12/2003 | Booth et al. | 347/104 |
| 2006/0181012 | A1 | 8/2006 | Kruijt | |
| 2007/0089620 | A1* | 4/2007 | Kim et al. | 101/123 |
| 2007/0126832 | A1 | 6/2007 | Kito | |
| 2010/0309492 | A1* | 12/2010 | Baxter | 358/1.8 |

FOREIGN PATENT DOCUMENTS

| | | | |
|---|---|---|---|
| GB | 2370533 | A | 7/2002 |
| GB | 2370813 | A | 7/2002 |
| GB | 2372234 | A | 8/2002 |
| JP | 07228383 | A | 8/1995 |
| JP | 10058802 | A | 3/1998 |
| JP | 2000318870 | A | 11/2000 |

* cited by examiner

TABLE FOR A PRINTER

CROSS-REFERENCE TO RELATED APPLICATIONS

This application is a National Stage of International Application No. PCT/GB2009/051598, filed Nov. 25, 2009. This application claims the benefit and priority of GB application 0821627.7 filed Nov. 26, 2008. The entire disclosures of the above applications are incorporated herein by reference.

BACKGROUND

This section provides background information related to the present disclosure which is not necessarily prior art.

1. Technical Field

This invention relates to a substrate support apparatus for a printer, for example including a printer table, for example for use in a flat bed printer. In examples described, the table comprises a vacuum table for holding a substrate in a printer.

2. Discussion

Vacuum tables are well known for use in supporting a substrate in a flat bed printer. In a common type of vacuum table, the table includes an upper surface for supporting a substrate being printed. A plurality of apertures is provided in the surface of the table, the apertures being connected to a source of negative pressure. The substrate is placed onto the table for printing, the substrate covering apertures on the table surface. During printing, when the negative pressure is applied, air is drawn through the apertures in the table; the negative pressure can therefore act to hold the substrate to the table.

However, problems can arise where the size of the substrate is less than the area of the table populated by the apertures. In such a situation, when the substrate is placed on the table, apertures remain uncovered by the substrate. Leaving such apertures uncovered during printing can be disadvantageous because the pressure source needs to be run at a relatively high power for sufficient negative pressure to be applied to hold the substrate to the table compared to an arrangement where all of the apertures are covered. The greater the numbers of apertures remaining uncovered, the greater the problem.

An additional problem can arise where apertures remain uncovered during a printing operation. Open apertures can lead to a high airflow near printhead nozzles, which can disrupt printing and/or lead to a reduction in print quality.

In an attempt to improve this arrangement, a mask is applied to the table to cover the apertures not covered by the substrate. Such masks may comprise for example paper or card or a plastics sheet material cut to the appropriate shape. In particular in cases where the area of the table not covered by the substrate is of particularly irregular shape, the mask may comprise several mask elements.

In some cases, satisfactory results can be obtained where the mask is simply placed on the table, because the application of the negative pressure during printing will also act to hold the mask to the table. However, in practical applications, it is generally desirable to fix the mask to the table, in particular where a similar layout of substrates is to be used for several consecutive printing operations. For example, it is common practice that, once the printing on the substrate is complete, the pressure source provides a positive pressure to the apertures on the table to assist in removal of the printed substrate. Such application of positive pressure has the effect also of dislodging the mask which, in particular where several substrates are to be printed using the same mask arrangement, is disadvantageous.

Where the mask comprises a plastics sheet, a tacky or adhesive backing may be provided to hold the mask to the surface. However, this can leave an adhesive residue on the surface of the table. Also, such a mask is not suitable for repeated application and removal from the table and can have a limited service life.

Alternatively, in particular where the mask comprises paper or card, the mask may be fixed in place on the table, for example using adhesive tape. However, such taping is labour intensive and adds significant time to the print cycle.

A further problem is that the tape used and/or the adhesive is often not resistant to the effects of radiation, for example UV radiation and/or heat to which it can be exposed during the printing cycle. In particular for masks subjected to several printing cycles, this can lead to loss of adhesion between the tape or mask material and the table and lifting and/or curling of the tape or mask material. This can then lead to loss of printing quality and/or halting of the printing cycle to reattach the tape.

If several sets of one or more substrates of similar configuration are to be printed using the same mask arrangement, then the mask is usually retained on the table for the printing of the sets of substrates. This can lead to a greater risk of the tape holding the mask becoming dislodged. Also, as mentioned above, it is common practice for the pressure source to be used to blow air through the apertures after the printing operation to assist in the removal of the substrate. This practice can lead to damage of the mask, and/or greater risk of parts of the tape and/or mask lifting from the table.

Attempts to overcome these problems have led to systems in which the apertures are arranged in zones on the table, the pressure applied to each zone being independently controllable. Thus in such arrangements one or more pressure sources are used selectively to apply negative pressure to one or more of the zones in an attempt to arrange for the negative pressure only to be applied to apertures covered by the substrate. However, experience of these systems has shown that the zones often do not correspond to the shapes of the substrates to be printed, and so some masking is often required even in such systems. Also, the pressure supply mechanism is greatly increased in complexity and cost to support the zones.

Aspects of the invention seek to overcome or mitigate one or more of these or other problems.

SUMMARY OF THE INVENTION

According to an aspect of the invention there is provided substrate support apparatus for a printer, the apparatus comprising: a table including a support surface for supporting a substrate during printing, the support surface including a plurality of substrate apertures; means for applying a negative pressure to the substrate apertures to hold the substrate to the table, a plurality of mask apertures and means for applying a negative pressure to the mask apertures to hold a mask to the support surface, wherein the apparatus is such that pressure can be applied to the substrate apertures and the mask apertures independently.

By providing specific mask apertures to hold the mask to the table, the requirement for taping the mask to the table can be avoided. Because pressure can be applied independently to the substrate and mask apertures, the mask can continue to be held to the table even when negative pressure has been released from the substrate apertures so that the substrate can be removed from the table.

As discussed further below, preferably a positive pressure can be applied to the substrate apertures independently of the mask apertures. In some arrangements, a positive pressure can be applied to the mask apertures independently of the substrate apertures.

Preferably the apparatus further includes a pressure source for applying pressure to the substrate apertures, and a separate pressure source for applying pressure to the mask apertures. Such an arrangement can give greater flexibility of operation of the apparatus, and can decrease complexity of the pressure supply arrangement. In preferred embodiments, each pressure source will be adapted to apply a negative pressure to the substrate or mask as required.

Preferably mask apertures are located in a region of the table separate from a region of the table including the substrate apertures. By having the mask apertures separate, it is possible to retain the negative pressure to the mask to hold it to the table even when the negative pressure holding the substrates to the table is released.

Preferably the mask apertures are in a region of the support surface.

Preferably the mask apertures are located at an edge region of the table. It is generally the case that no substrate apertures are located within an edge region around the perimeter of the table. Preferably the mask apertures are located in a part of this perimeter or edge region. In some printer arrangements, the edge region comprises about 1 inch (2.5 cm) at the perimeter (or part of the perimeter) of the table.

Preferably the mask apertures are located on one edge of the table. In some arrangements, it will be preferred for the mask apertures to be located at all or the majority of the perimeter or edge region of the table. In some cases, it will be considered desirable, for example because more of the mask is held to the table, and also several masks might be held to the table. However, in some arrangements, it is preferred that the mask be held only at one edge. This can be advantageous for example in arrangements where positive pressure is applied to substrate apertures during the unloading of the substrates. During this step, preferably a negative pressure is applied to the mask apertures to hold the mask to the table. The application of the positive pressure to the substrate apertures will act to lift the mask from the table in those regions of the mask over the substrate apertures. If the mask were retained at more than one or all edges, then the risk of the mask being dislodged from its position is increased. However, where the mask is held at only one edge, the positive pressure application to the substrate apertures will act only to lift the mask; because the mask is less constrained, the risk of it being dislodged from its position is reduced.

Generally the substrate table is a rectangular shape; where a different shape is used, it will be understood that features described herein in relation to rectangular tables will be applicable for non-rectangular tables.

Preferably the edge region including the mask apertures is remote from a reference element associated with the table. In some arrangements, a reference point is provided at a corner or edge of the table. Preferably the mask apertures are remote from such a point or element so that the mask is less likely to interfere with any reference element location.

Preferably the mask apertures are located at a long edge of the table. As indicated above, tables are generally rectangular; preferably the mask apertures are located at a long edge of the rectangle.

Preferably the mask comprises one or more sheets of plastics material.

Preferably the mask comprises a semi-rigid material. Preferably the mask of sheet material is effectively stiff in the plane of the sheet, preferably the sheet material is such that it is resistant to crumpling, bending and/or folding when on the support surface. The sheet material may be at least partly self-supporting, preferably in that it can be held generally horizontally at a first edge and the vertical deflection of the sheet is such that the angle of deflection of the sheet (having regard to an edge of the sheet remote from the held edge) is preferably less than 45 degrees, preferably less than 30 degrees, less than 20 degrees or less than 10 degrees. In some arrangements, the mask material may be substantially rigid in that there is substantially no vertical deflection of the sheet when it is held substantially horizontally at an edge.

Preferably the mask is such that it is semi-rigid in that it can be deflected up and down on the table, but if it does so, it returns to substantially (preferably exactly) the same position on the table. A suitable material includes celluloid film. However, thin films, and in particular stretchable films, for example LDPE film, would be inappropriate in most applications.

Preferably a sheet-form mask is resistant to deformation in the plane of the sheet.

Preferably the material of the mask is substantially heat resistant, for example at a temperature of more than 70 degrees C., preferably more than 100 degrees C., preferably more than 150 degrees C.

Preferably the stiffness of the material is retained at such elevated temperatures. During printing, the table may become heated, and/or the mask may be exposed to heat from the printing apparatus, for example lamps and/or dryers.

The mask may comprise for example a film or sheet including a polymer material. A thermoplastic or thermoset material may be used. The mask may for example include acetate, cellulose acetate, polyester, polyethylene, polypropylene or any other appropriate material. In an example, the mask may comprise a semi-rigid sheet of polyester material having a thickness of about 300 microns. The mask may include fillers or additives, for example to increase the stiffness of the material. For example, the mask may comprise a composite material including stiffening fibres or particles, for example in a polymer matrix, for example a resin.

The mask may include material other than plastics material. For example, the mask may include paper, card, steel shim or other material. The mask may include more than one material. The mask may include several elements, which may include the same or different materials.

The thickness of the material is preferably such that the desired mechanical properties of the mask are obtained. The thickness may be for example less than 1 cm, less than 0.5 cm, or less than 0.3 cm.

In some examples, it may be preferred for mask material to be used having a similar thickness to that of the substrate being printed. In the case of a thin substrate, the thin mask material has to be carefully chosen in some examples to be both rigid enough and substantially insensitive to raised temperature. For thicker materials, meeting the stiffness and heat resistance requirements may be less of a problem, and a wider choice can be available.

Preferably the upper surface of the mask (the surface opposed to the mask surface on the table) is of dark colour and/or substantially non-reflective. This is preferred where for example UV lamps are used in the printing apparatus, to minimise reflection from the mask. For example, the mask may be black, or have a black coating or layer on a surface of the mask.

Preferably the apparatus further includes a mask storing device for retaining or storing a plurality of mask elements. Preferably the apparatus includes a plurality of masks for use for different substrate arrangements. Such masks are advantageously stored in the region of the table, preferably adjacent the edge of the table including the mask apertures. For example, the masks might be mounted in the apparatus or printer such that they are held at an edge and they can be rotated from the storage position into position on the table.

The apertures of the substrate and/or the mask may be provided in a plurality of zones.

Preferably the apparatus is adapted for use in an ink jet printer. Preferably the apparatus is adapted for use in a flat bed printer. Preferably the apparatus is for use in a digital printer.

The invention further provides a method of masking a substrate support table for a printer including a support surface for supporting a substrate during printing, the support surface including a plurality of substrate apertures, and further including a plurality of mask apertures, the method comprising: applying a mask element to the table, the mask covering mask apertures and substrate apertures, applying a negative pressure to the mask apertures to hold the mask to the support surface; applying a substrate to the table, the substrate covering substrate apertures; applying a negative pressure to substrate apertures independent from the application of pressure to the mask apertures, the negative pressure holding the substrate to the table.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa.

BRIEF DESCRIPTION OF THE DRAWINGS

Preferred features of the present invention will now be described, purely by way of example, with reference to the accompanying drawings, in which.

Figure 1:
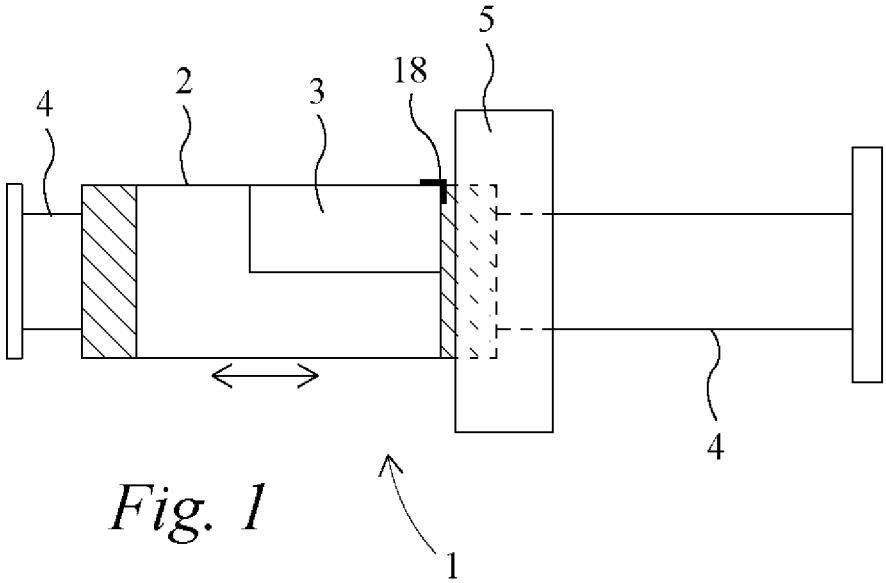
FIG. 1 shows schematically a plan view of a flat bed printer arrangement including a table.

The drawings described herein are for illustrative purposes only of selected embodiments and not all possible implementations, and are not intended to limit the scope of the present disclosure.

DETAILED DESCRIPTION OF THE PREFERRED EMBODIMENTS

Example embodiments will now be described more fully with reference to the accompanying drawings.

Corresponding reference numerals indicate corresponding parts throughout the several views of the drawings.

An example of a flat bed printer is shown schematically in FIG. 1.

FIG. 1 shows a flat bed printer 1 comprising a substrate table 2 for supporting a substrate 3 for printing. The upper surface of the table supporting the substrate 3 is flat and generally rectangular, the lower surface of the table 2 (not shown) is mounted on a carriage mechanism including rails 4 extending parallel to the plane of the support surface. A motor and associated mechanism is provided for translating the table 2 backwards and forwards along the rails 4.

Printing apparatus 5 is mounted on a frame extending above the substrate table 2 and extending transverse to the direction of movement of the table 2 on the rails 4. The printing apparatus 5 includes one or more printhead arrays and may include other apparatus for example radiation sources for effecting curing of curable ink as is known in the art.

During printing, the table 2 is reciprocated under the printing apparatus 5 at high speed. It is important that during printing the substrate 3 is held to the table so that it does not move relatively to the table during printing. This is, in part, because the position of the substrate 3 is determined and monitored with reference to the position of the table. Also, there is a benefit in the substrate being held flat onto the table so that the upper surface onto which the ink is deposited is flat. Lifting or wrinkling of the substrate on the table can lead to a reduction in print quality of the image printed on the substrate.

Figure 2:
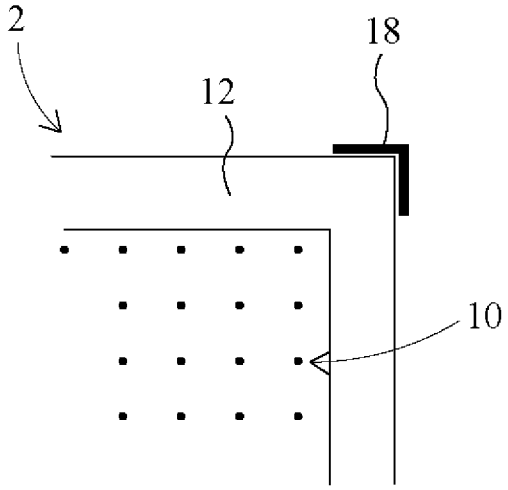
FIG. 2 shows a plan view a part of a substrate table

A negative pressure is applied to the substrate to hold it to the table. FIG. 2 shows a detail of the table 2 in which the apertures 10 on the upper surface can be seen. In the arrangement shown, the apertures are arranged in a generally square grid, although other arrangements are possible. The apertures extend through the upper surface of the table 2 and are linked to a negative pressure source for example in a conventional manner. Commonly, the table is generally hollow so that air can flow through it.

The apertures 10 extend across the whole of the upper surface of the table 2 except for an edge region 12 extending around the perimeter of the table where there are no apertures.

As is common in flat bed printing systems, one corner of the table 2 is designated as the reference corner 18 as described further below.

Figure 3:
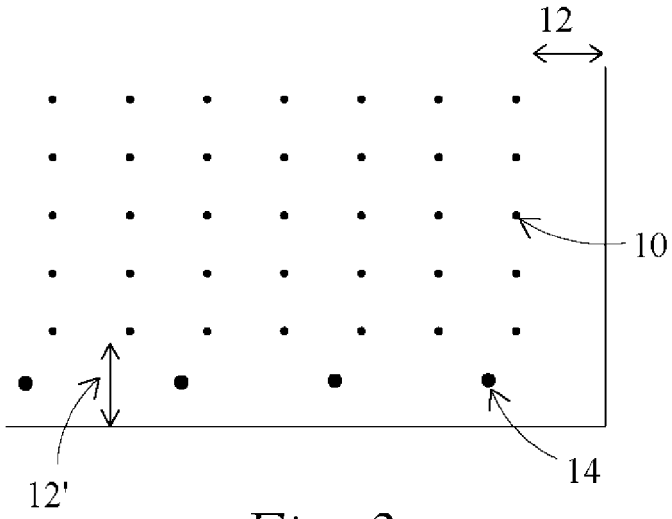
FIG. 3 shows a plan view of an edge region including masking apertures

As shown in FIG. 3, within a mask retaining portion 12' of the edge region 12 are provided a row of mask apertures 14. The mask apertures 14 extend through the upper surface of the table and are connected to a negative pressure supply. As discussed in further detail below, negative pressure is applied to the mask apertures 14 to hold the mask to the table.

Figure 4B:
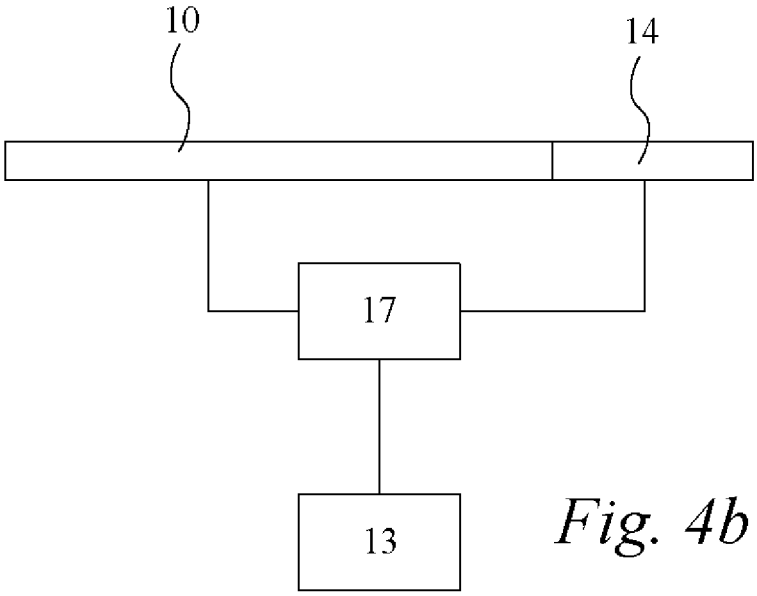
FIGS. 4*a* and 4*b* show alternative examples of pressure source arrangements
Figure 4A:
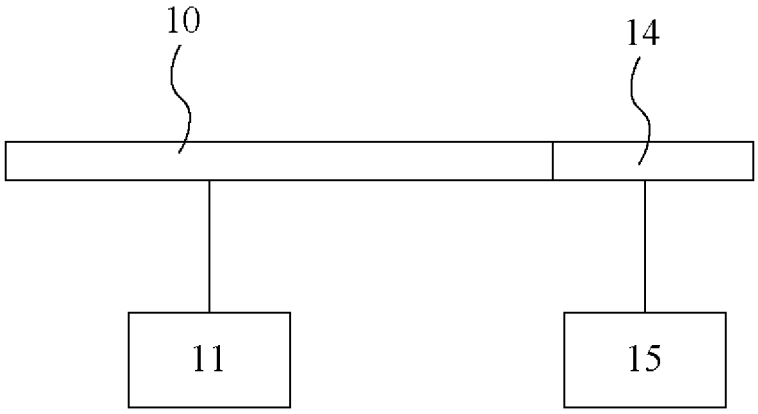

FIGS. 4*a* and 4*b* show schematically two arrangements by which negative pressure can be applied to the substrate apertures 10 and the mask apertures 14. In FIG. 4*a*, two separate negative pressure sources 11 and 15 are provided. Source 11 can be used to apply a negative pressure to the substrate apertures 10, and negative pressure source 15 can apply a negative pressure to mask apertures 14. In the arrangement of FIG. 4*b*, a single negative pressure source 13 is provided which is connected to a routing device 17. By control of the routing device 17, it is possible to control individually the application of negative pressure to the substrate apertures 10 and the mask apertures 14.

The arrangement of FIG. 4*a* is preferred in many cases because the use of two sources facilitates set up and operation and allows positive pressure easily to be applied to the substrate to aid removal from the table 2 when printing is complete.

Figure 5:
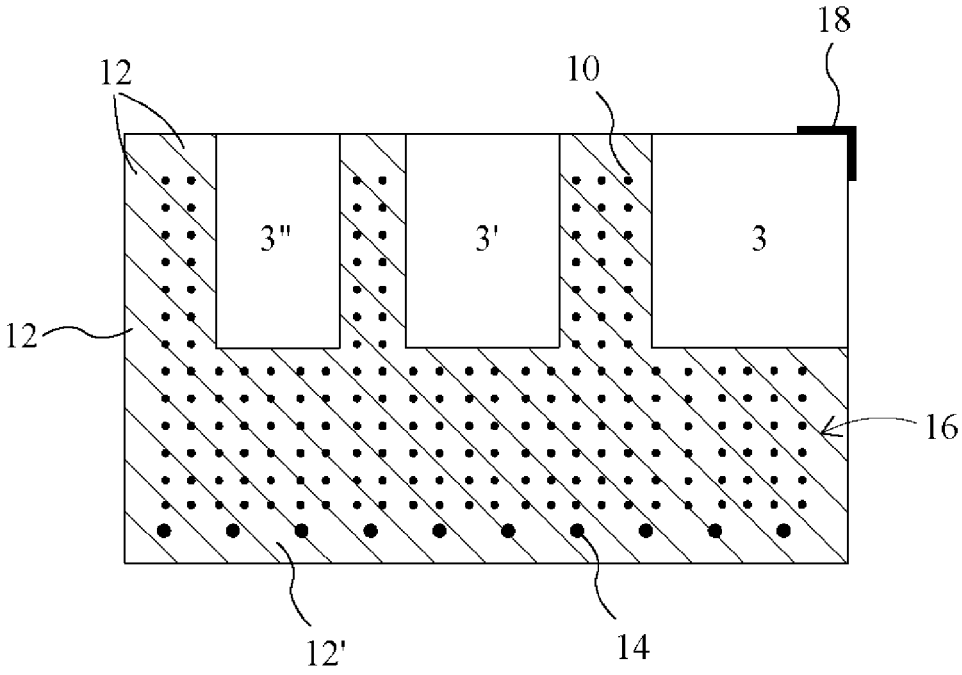
FIG. 5 shows schematically a plan view of the substrate table including substrates and a mask loaded.

FIG. 5 shows a table 2 having three substrates 3, 3', 3" arranged on its surface for printing. The substrates 3, 3', 3" are arranged spaced apart on the table 2 in accordance with usual practice.

A mask 16 comprising a sheet of plastics material is cut to have a shape corresponding to the shape of the region of the table 2 not covered by the substrates 3, 3', 3". In this case, the mask 16 generally has a comb-shape. The mask may be prepared for example by cutting a sheet of material using a cutting table, for example a known cutting table of Zund Plotting Systems (UK) Limited or KONGSBERG cutting tables of Esko NV. Users of flatbed printers usually have a cutting table for finishing after printing, and so it is advantageous for this to be used also for the preparation of the mask.

The mask 16 is shaped so that when it is mounted in place on the table 2, the mask 16 covers all of the substrate apertures 10 not covered by the substrate and also extends into the mask retaining portion 12' of the edge region 12 to cover all of the mask apertures 14.

Where the negative pressure arrangement of FIG. 4*a* is used, it will be seen that on activation of the two negative pressure sources 11, 15, the negative pressure applied to the substrate apertures 10 will act to hold both the substrates 3, 3', 3" and the mask 16 to the table 2. In addition, the negative pressure applied to the mask apertures 14 holds the mask 16 to the table 2.

When the negative pressure applied to the substrate apertures 10 is released, the substrate 3 can be removed from the table 2, but the mask is still held in place by means of the application of the negative pressure to the mask apertures 14 by the mask negative pressure source 15.

In an example of a printing operation, the following steps may be carried out.

Step 1—Apply Mask

The mask 16 is applied to the support surface of the table so as to cover some of the substrate apertures 10 and also at least some of the mask apertures 14. Negative pressure is applied to the mask apertures 14 to hold the mask in place. It is convenient to apply the negative pressure to the mask apertures 14 only after the mask has been placed in position.

Step 2—Apply Substrates

Retaining the negative pressure applied to the mask apertures 14, the substrates are loaded onto the table to cover some of the substrate apertures 10. Negative pressure is applied to the substrate apertures 10 to hold the substrates in place. The mask is also positioned over some of the substrate apertures 10 and thus the negative pressure applied thereto will also act to hold the mask in place.

Step 3—Printing

The printing of the substrate is carried out. The negative pressure is applied to the substrate apertures 10 during printing. Optionally, the negative pressure to the mask apertures 14 may be released because the mask is held also by the negative pressure applied to the substrate apertures 10. However, in practice, the mask aperture negative pressure will also continue to be applied.

Step 4—Unloading Printed Substrate

The negative pressure is applied to the mask apertures 14 to hold the mask in place. The negative pressure to the substrate apertures 10 is released and/or a positive pressure is applied to at least some of the substrate apertures 10 to assist in the removal of the printed substrate.

If further substrates requiring the same mask arrangement are to be printed, then the mask negative pressure is maintained, and steps 2 to 4 are repeated as necessary.

Registration of the substrates and/or the masks in relation to the table is important in most applications so that accurate printing of the substrates can be carried out.

In the arrangement shown in FIG. 5, a substrate 3 is registered to the reference corner 18. Further reference points may be provided for example to register the mask to the table and/or the further substrates 3', 3".

In a preferred arrangement, in particular where more than one substrate is applied to the table, the mask is registered to a reference point on the table, and the substrates are registered to the mask.

Where a single substrate is to be placed on the table, in a preferred arrangement, the substrate is registered to the reference point, and the mask is registered to the substrate.

Alternative arrangements are possible.

The mask may include any appropriate material. For example where the mask comprises a sheet of plastics material, the material might comprise a 300 micron thick polystyrene sheet. Other materials might be used. Preferred materials include thin resilient plastics sheet material.

The masks may be disposable, for example single use, or might be semi disposable (for example after several times being used), or might be usable for many print cycles. In a preferred printer arrangement, a plurality of masks are mounted in or adjacent the printer. A mask is selected from the available masks before the printing operation.

The required mask shape might be for example created using flat bed cutters. Computer data regarding the substrates to be printed can be used in calculating the shape of mask(s) required. Data from the calculation can be used to cut the correct shape from the plastics material.

The negative pressure applied to the apertures might be for example 100 mBar.

The pitch of the substrate apertures 10 for a known table array is about 1 inch. The pitch of the mask apertures may be less or the same, but in many examples will be greater than that of the substrate apertures 10.

Preferably the pressure source for the mask apertures 14 is chosen so that it is not essential to mask any mask apertures 14 not being used in a particular print cycle. Therefore preferably a large vacuum pump is used to apply negative pressure to the mask apertures 14.

While it is envisaged that the mask apertures will be incorporated into newly built printer tables, retrofitting of elements of the invention to existing printers is envisaged. For example the mask apertures might be provided as a part of an element mounted with the printer table in an existing printer arrangement.

It will be understood that the present invention has been described above purely by way of example, and modification of detail can be made within the scope of the invention.

Each feature disclosed in the description, and (where appropriate) the claims and drawings may be provided independently or in any appropriate combination.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A flat-bed printer comprising substrate support apparatus, the apparatus comprising:

a table including a support surface for supporting at least one substrate during printing, the support surface defining a first region including a plurality of substrate apertures, wherein the table is adapted for supporting one or more substrates partially covering the first region and a mask having cut-outs generally corresponding to the or each substrate, a negative pressure source for applying negative pressure to the substrate apertures to hold the or each substrate to the first region of the table, a plurality of mask apertures located in a second region of the support surface separate from the first region of the support surface and a negative pressure source for applying negative pressure to the mask apertures to hold a mask to the support surface, so that a mask is held by pressure applied to both the substrate and the mask apertures, the negative pressure source for applying negative pressure to the substrate apertures and the negative pressure source for applying negative pressure to the mask apertures being one of: a first negative pressure source for applying a negative pressure to the substrate apertures and a second negative pressure source for independently applying a negative pressure to the mask apertures; or a negative pressure source coupled to a routing device for controlling individually and independently the application of negative pressure to the substrate apertures and to the mask apertures, wherein the negative pressure source for applying negative pressure to the substrate apertures and the negative pressure source for applying negative pressure to the mask apertures are configured to selectively release the negative pressure from the substrate apertures while retaining the negative pressure at the mask apertures, so that pressure can be applied to the substrate apertures and the mask apertures independently to enable selective release of a substrate from the support surface while retaining the mask by negative pressure applied to the mask apertures.

2. A flat-bed printer according to claim 1, wherein the mask apertures are located at an edge region of the table.

3. A flat-bed printer according to claim 1, wherein the mask apertures are located on one edge of the table.

4. A flat-bed printer according to claim 2, wherein the edge region including the mask apertures is remote from a reference element associated with the table.

5. A flat-bed printer according to claim 2, wherein the mask apertures are located at a long edge of the table.

6. A flat-bed printer according to claim 1 comprising a mask which includes one or more sheets of plastics material.

7. A flat-bed printer according to claim 1 comprising a mask which comprises a semi-rigid material.

8. A flat-bed printer according to claim 1 comprising a mask which is substantially heat resistant at a temperature of 70 degrees C.

9. A flat-bed printer according to claim 1, wherein a surface of the mask is of dark colour and/or is substantially nonreflective.

10. A flat-bed printer according to claim 1, further including a mask storage device for storing a plurality of mask elements.

11. A flat-bed printer according to claim 1, wherein the flat-bed printer comprises an ink jet printer.

12. A method of masking a substrate support table for a printer including a support surface for supporting at least one substrate during printing, the support surface defining a first region including a plurality of substrate apertures and being adapted for supporting one or more substrates partially covering the first region and at least one mask having cut-outs generally corresponding to the or each substrate, and further including a plurality of mask apertures, the method comprising:

applying a mask element to the table, the mask covering mask apertures and substrate apertures, applying a negative pressure to the mask apertures to hold the mask to the support surface, applying a substrate to the table, the substrate covering substrate apertures, applying a negative pressure to substrate apertures independent from the application of pressure to the mask apertures, the negative pressure holding the substrate to the table, wherein the mask is held by negative pressure applied to both the substrate and mask apertures, and selectively releasing the negative pressure from the substrate apertures to release the substrate from the support surface while retaining the mask on the table by negative pressure applied to the mask apertures.

* * * * *